US010280807B2

(12) United States Patent
Kobayashi

(10) Patent No.: US 10,280,807 B2
(45) Date of Patent: May 7, 2019

(54) WASTE HEAT RECOVERY APPARATUS

(71) Applicant: TOYOTA JIDOSHA KABUSHIKI KAISHA, Toyota-shi, Aichi-ken (JP)

(72) Inventor: Hideo Kobayashi, Mishima (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 189 days.

(21) Appl. No.: 15/101,616

(22) PCT Filed: Dec. 3, 2014

(86) PCT No.: PCT/IB2014/002631

§ 371 (c)(1),
(2) Date: Jun. 3, 2016

(87) PCT Pub. No.: WO2015/082975

PCT Pub. Date: Jun. 11, 2015

(65) Prior Publication Data

US 2016/0376934 A1 Dec. 29, 2016

(30) Foreign Application Priority Data

Dec. 5, 2013 (JP) ..... 2013-251803

(51) Int. Cl.
*F01K 13/00* (2006.01)
*F01K 19/04* (2006.01)
(Continued)

(52) U.S. Cl.
CPC ..... *F01K 23/065* (2013.01); *F01K 3/185* (2013.01); *F01K 13/00* (2013.01); *F01K 19/04* (2013.01); *F01N 5/02* (2013.01); *F02G 5/02* (2013.01)

(58) Field of Classification Search
CPC ..... F01K 13/00; F01K 19/04; F01K 23/065; F01K 3/185; F01N 5/02; F02G 5/02
See application file for complete search history.

(56) References Cited

U.S. PATENT DOCUMENTS 3,774,397 A * 11/1973 Engdahl ..... F01K 13/00 137/59
4,996,845 A * 3/1991 Kim ..... B60H 1/00007 237/12.1
(Continued)

FOREIGN PATENT DOCUMENTS

CN 102797524 A 11/2012
CN 203271841 U 11/2013
(Continued)

*Primary Examiner* — Ngoc T Nguyen
*Assistant Examiner* — Matthew T Largi
(74) *Attorney, Agent, or Firm* — Sughrue Mion, PLLC

(57) ABSTRACT

A waste heat recovery apparatus includes a heat exchanger, an expander, a condenser, a first tank, a reflux portion, a first passage portion, and a second passage portion. The heat exchanger is configured to generate steam. The expander is configured to recover heat energy of the generated steam as power. The condenser is configured to condense the steam passing through the expander. An inlet portion of the condenser is arranged above an outlet portion of the expander. The first tank is configured to store the working fluid liquefied by the condenser. The reflux portion is configured to reflux the liquid-state working fluid in the first tank to the heat exchanger. The first passage portion connects the outlet portion of the expander and the inlet portion of the condenser to each other. The second passage portion connects the first passage portion and the first tank to each other.

13 Claims, 9 Drawing Sheets

(51) Int. Cl.

| | |
|---|---|
| ***F01K 23/06*** | (2006.01) |
| ***F01K 3/18*** | (2006.01) |
| ***F01N 5/02*** | (2006.01) |
| ***F02G 5/02*** | (2006.01) |

(56) References Cited

U.S. PATENT DOCUMENTS

| | | | | |
|---|---|---|---|---|
| 5,799,481 | A * | 9/1998 | Fetescu | F01K 17/025 60/39.182 |
| 7,325,400 | B2 * | 2/2008 | Cunningham | F01K 7/40 60/645 |
| 2010/0146949 | A1 * | 6/2010 | Stobart | B60H 1/00492 60/300 |
| 2011/0167823 | A1 * | 7/2011 | Berger | F01K 9/003 60/645 |

FOREIGN PATENT DOCUMENTS

| | | | | |
|---|---|---|---|---|
| JP | 2001-174166 | A | | 6/2001 |
| JP | 2001174166 | A | * | 6/2001 |
| JP | 2010-285893 | A | | 12/2010 |
| JP | 2011-149386 | A | | 8/2011 |

* cited by examiner

WASTE HEAT RECOVERY APPARATUS

BACKGROUND OF THE INVENTION

1. Field of the Invention

The invention relates to a waste heat recovery apparatus.

2. Description of Related Art

Waste heat recovery apparatuses that evaporate a working fluid with heat from a heat source, generate steam, and recover heat energy of the generated steam as power are known. Such waste heat recovery apparatuses are disclosed in, for example, Japanese Patent Application Publication No. 2001-174166 (JP 2001-174166 A), Japanese Utility Model Application Publication No. 2011-149386 (JP 2011-149386 A), and Japanese Utility Model Application Publication No. 2010-285893 (JP 2010-285893 A). JP 2001-174166 A discloses a rankine cycle system that is mounted on a vehicle. Drawings of JP 2001-174166 A disclose an example in which an inlet portion of a condenser is arranged above an outlet portion of an expander. JP 2011-149386 A discloses a rankine cycle system that promotes warm-up of an expander and avoids steam condensation in the expander. JP 2010-285893 A discloses a waste heat recovery apparatus in which a condenser is disposed below a turbine.

SUMMARY OF THE INVENTION

In the waste heat recovery apparatuses, the steam that passes through the expander is condensed by the condenser. The inlet portion of the condenser may be arranged above the outlet portion of the expander as described above, and the steam that becomes low-temperature and low-pressure steam while passing through the expander may be condensed before flowing into the condenser due to further temperature reduction. Accordingly, the condensed working fluid may be accumulated in the vicinity of the outlet portion of the expander and permeate into the expander in the waste heat recovery apparatuses having this configuration. This, as a result, may cause an output of the expander to be reduced.

The invention provides a waste heat recovery apparatus that is capable of preventing or suppressing expander output reduction that is attributable to arrangement of an outlet portion of an expander and an inlet portion of a condenser.

A waste heat recovery apparatus according to an aspect of the invention includes a heat exchanger, an expander, a condenser, a first tank, a reflux portion, a first passage portion, and a second passage portion. The heat exchanger is configured to evaporate a working fluid with heat from a heat source and generate steam. The expander is configured to recover heat energy of the generated steam as power. The condenser is configured to condense the steam passing through the expander. An inlet portion of the condenser is arranged above an outlet portion of the expander. The first tank is configured to store the working fluid liquefied by the condenser. The reflux portion is configured to reflux the liquefied working fluid in the first tank to the heat exchanger. The first passage portion connects the outlet portion of the expander and the inlet portion of the condenser to each other. The second passage portion connects the first passage portion and the first tank to each other.

In the waste heat recovery apparatus according to the aspect described above, the first passage portion may be connected to the inlet portion of the condenser through a position lower than the outlet portion of the expander. The second passage portion may be connected to a part of the first passage portion lower than the outlet portion of the expander.

In the waste heat recovery apparatus according to the aspect described above, the second passage portion may be connected to a lowermost portion of the first passage portion.

In the waste heat recovery apparatus according to the aspect described above, a part of the first passage portion to which the second passage portion is connected may be a second tank configured to store the liquefied working fluid.

The waste heat recovery apparatus according to the aspect described above may further include a cooler disposed in the second passage portion, the cooler configured to cool the working fluid flowing through the second passage portion by heat exchange.

In the waste heat recovery apparatus according to the aspect described above, the cooler may perform heat exchange between the working fluid flowing through the second passage portion and the working fluid flowing through the reflux portion.

The waste heat recovery apparatus according to the aspect described above may further include a heater configured to heat the working fluid flowing through the reflux portion after passing through the cooler by heat exchange.

In the waste heat recovery apparatus according to the aspect described above, the second passage portion may be smaller in passage cross-sectional area than a part of the first passage portion on a downstream side from a part of the first passage portion to which the second passage portion is connected.

The waste heat recovery apparatus according to the aspect described above may further include a limiting valve configured to limit a flow of the steam of the working fluid in the second passage portion.

In the waste heat recovery apparatus according to the aspect described above, the limiting valve may be operated according to a liquefied working fluid storage amount in the first passage portion.

In the waste heat recovery apparatus according to the aspect described above, the limiting valve may be a float valve operated by a float smaller in specific gravity than the liquefied working fluid, the float valve being disposed in the first passage portion.

In the waste heat recovery apparatus according to the aspect described above, the heat exchanger may be an internal combustion engine and the waste heat recovery apparatus may be disposed in a vehicle.

According to the invention, expander output reduction that is attributable to arrangement of the outlet portion of the expander and the inlet portion of the condenser can be prevented or suppressed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of the invention will be described with reference to the accompanying drawings.

Figure 1:
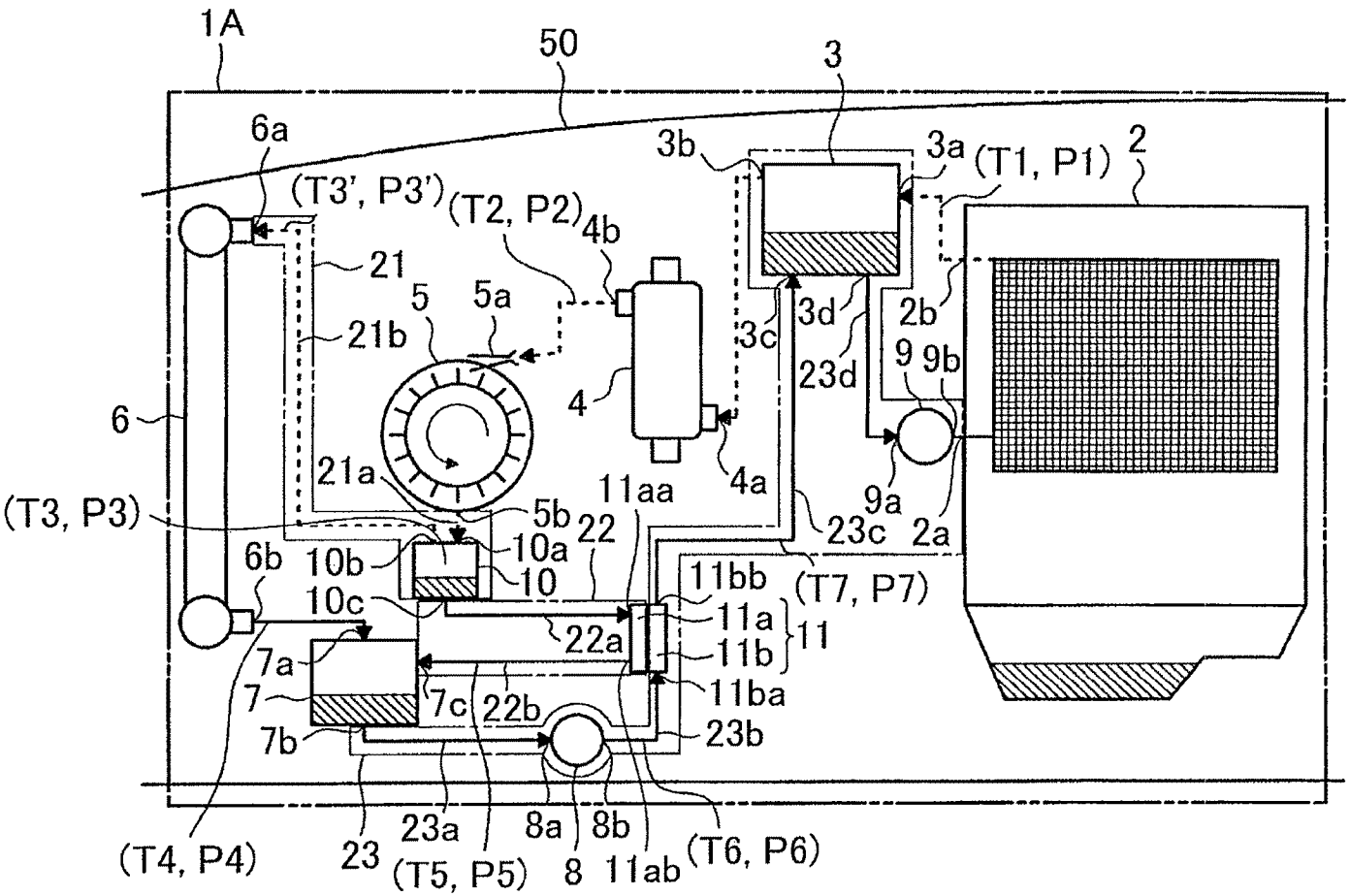
FIG. 1 is a schematic configuration diagram of a waste heat recovery apparatus according to a first embodiment.

FIG. 1 is a schematic configuration diagram of a waste heat recovery apparatus 1A. Piping that is illustrated by the dotted line is piping where mainly steam flows. Piping that is illustrated by the solid line is piping where mainly a liquid-state working fluid flows. A flow direction of the working fluid is also illustrated in the piping. In FIG. 1, temperatures and pressures of the working fluid at respective portions are also illustrated in the parentheses. The waste heat recovery apparatus 1A is provided with an internal combustion engine 2, a gas-liquid separator 3, a superheater 4, a turbine 5, a condenser 6, a tank 7, pumps 8, 9, a tank 10, a cooler 11, and passage portions 21, 22, 23. The waste heat recovery apparatus 1A is disposed in a vehicle 50.

The internal combustion engine 2 is an example of a heat exchanger that evaporates the working fluid with heat from a heat source and generates the steam. Specifically, the heat source is combustion gas. Specifically, the working fluid is a coolant for the internal combustion engine 2. The steam that is generated in the internal combustion engine 2 is discharged out of the internal combustion engine 2 via an outlet portion 2*b*. The discharged steam is supplied to the gas-liquid separator 3.

The working fluid flows into the gas-liquid separator 3 via an inlet portion 3*a* of the gas-liquid separator 3. The gas-liquid separator 3 separates the working fluid that is supplied from the internal combustion engine 2 into the steam and the liquid-state working fluid. The separated steam is discharged from the gas-liquid separator 3 via an outlet portion 3*b* of the gas-liquid separator 3. The inlet portion 3*a* and the outlet portion 3*b* are disposed in an upper portion of the gas-liquid separator 3. The inlet portion 3*a* is a first inlet portion of the gas-liquid separator 3, and the outlet portion 3*b* is a first outlet portion of the gas-liquid separator 3.

The steam that is discharged from the gas-liquid separator 3 is supplied to the superheater 4. The steam flows into the superheater 4 via an inlet portion 4*a* of the superheater 4. The superheater 4 superheats the steam. The superheated steam is discharged from the superheater 4 via an outlet portion 4*b* of the superheater 4. The outlet portion 4*b* is arranged above the inlet portion 4*a*. The discharged steam is supplied to the turbine 5.

The steam is ejected into the turbine 5 via an inlet portion 5*a* of the turbine 5. The turbine 5 is an example of an expander that recovers heat energy of the steam that is generated as power. After the recovery of the heat energy, the steam is discharged out of the turbine 5 via an outlet portion 5*b* of the turbine 5. The steam that is discharged from the turbine 5 is supplied to the condenser 6. The steam flows into the condenser 6 via an inlet portion 6*a* of the condenser 6.

The condenser 6 is an example of a condenser that condenses the steam which passes through the turbine 5. The liquefied working fluid is discharged out of the condenser 6 via an outlet portion 6*b* of the condenser 6. The outlet portion 6*b* is disposed below the inlet portion 6*a*. The condenser 6 is disposed for the working fluid to flow downward. Accordingly, the liquefied working fluid can be guided to the outlet portion by gravity in the condenser 6. The reason why the condenser 6 is disposed for the working fluid to flow downward will be described in detail later.

The outlet portion 6*b* is connected to an inlet portion 7*a* of the tank 7. The inlet portion 7*a* is arranged below the outlet portion 6*b*. The working fluid that is liquefied by the condenser 6 can be guided by gravity from the outlet portion 6*b* to the inlet portion 7*a*. The inlet portion 7*a* is a first inlet portion of the tank 7 and is disposed in an upper portion of the tank 7. The working fluid that is liquefied by the condenser 6 flows into the tank 7 via the inlet portion 7*a*.

The tank 7 is a first tank and stores the working fluid that is liquefied by the condenser 6. The liquid-state working fluid is discharged out of the tank 7 via an outlet portion 7*b* of the tank 7. The outlet portion 7*b* is disposed in a lower portion of the tank 7. The outlet portion 7*b* is open to a bottom wall portion of the tank 7. It is preferable that the outlet portion 7*b* be open to the bottom wall portion of the tank 7, but the outlet portion 7*b* may be open to a side wall portion of the tank 7. The outlet portion 7*b* is connected to an inlet portion 8*a* of the pump 8. The inlet portion 8*a* is arranged below the outlet portion 7*b*. The liquid-state working fluid that is stored in the tank 7 can be guided by gravity from the outlet portion 7*b* to the inlet portion 8*a*.

The pump 8 is a first pump and supplies the liquid-state working fluid from the tank 7 to the gas-liquid separator 3. The pump 9 is a second pump and supplies the liquid-state working fluid that is stored in the gas-liquid separator 3 to the internal combustion engine 2. The working fluid that is supplied by the pump 9 flows into the internal combustion engine 2 via an inlet portion 2*a* of the internal combustion engine 2. Ebullient cooling is performed in the internal combustion engine 2 so that the steam is generated.

The passage portion 21 is a first passage portion and is provided with piping 21*a*, piping 21*b*, and the tank 10. The passage portion 21 connects the turbine 5 and the condenser 6 to each other. Specifically, the piping 21*a* connects the outlet portion 5*b* and an inlet portion 10*a* of the tank 10 to each other. The piping 21*b* connects an outlet portion 10*b* of the tank 10 and the inlet portion 6*a* to each other. The piping 21*a* extends downward from the outlet portion 5*b*. The piping 21*a* is connected to the outlet portion 5*b* in a state where the piping 21*a* extends upward from the tank 10. The piping 21*b* is connected to the inlet portion 6*a* in a state where the piping 21*b* extends upward from the tank 10. The passage portion 21 is connected to the inlet portion 6*a* through a position lower than the outlet portion 5*b*.

The tank 10 is a second tank and stores the liquid-state working fluid. The inlet portion 10*a* and the outlet portion 10*b* are disposed in an upper portion of the tank 10. An outlet portion 10*c* is disposed in a lower portion of the tank 10. The outlet portion 10*b* is a first outlet portion of the tank 10, and the outlet portion 10*c* is a second outlet portion of the tank 10. The outlet portion 10*c* is open to a bottom wall portion of the tank 10. It is preferable that the outlet portion 10*c* be open to the bottom wall portion of the tank 10, but the outlet portion 10*c* may be open to a side wall portion of the tank 10.

The passage portion 22 is a second passage portion and is provided with piping 22*a*, piping 22*b*, and the cooler 11. The passage portion 22 connects the tank 10 and the tank 7 to each other. Specifically, the piping 22*a* connects the outlet portion 10*c* and an inlet portion 11*aa* of the cooler 11 to each other. The piping 22*b* connects an outlet portion 11*ab* of the cooler 11 and inlet portion 7*c* of the tank 7 to each other. The inlet portion 11*aa* is an inlet portion of a heat exchange passage portion 11*a* of the cooler 11, and the outlet portion 11*ab* is an outlet portion of the heat exchange passage portion 11*a* of the cooler 11. The inlet portion 7*c* is a second inlet portion of the tank 7 and is disposed in the upper portion of the tank 7.

The passage portion 23 is a reflux portion and refluxes the liquid-state working fluid in the tank 7 to the internal combustion engine 2. The passage portion 23 is provided with piping 23*a*, piping 23*b*, piping 23*c*, piping 23*d*, the pump 8, the cooler 11, and the pump 9. The passage portion 23 connects the tank 7 and the internal combustion engine 2 to each other. Specifically, the piping 23*a* connects the outlet portion 7*b* and the inlet portion 8*a* to each other. The piping 23*b* connects an outlet portion 8*b* of the pump 8 and an inlet portion 11*ba* of the cooler 11 to each other. The piping 23*c* connects an outlet portion 11*bb* of the cooler 11 and an inlet portion 3*c* of the gas-liquid separator 3 to each other. The piping 23*d* connects an outlet portion 3*d* of the gas-liquid separator 3 and an inlet portion 9*a* of the pump 9 to each other. An outlet portion 9*b* of the pump 9 is directly connected to the inlet portion 2*a* of the internal combustion engine 2.

The inlet portion 11*ba* is an inlet portion of a heat exchange passage portion 11*b* of the cooler 11. The outlet portion 11*bb* is an outlet portion of the heat exchange passage portion 11*b* of the cooler 11. The inlet portion 3*c* is a second inlet portion of the gas-liquid separator 3. The outlet portion 3*d* is a second outlet portion of the gas-liquid separator 3. The inlet portion 3*c* and the outlet portion 3*d* are disposed in a lower portion of the gas-liquid separator 3.

The cooler 11 is disposed in the passage portion 22. Specifically, the heat exchange passage portion 11*a* of the cooler 11 is disposed in the passage portion 22. Accordingly, the passage portion 22 is, specifically, provided with the heat exchange passage portion 11*a* of the cooler 11. The cooler 11 is also disposed in the passage portion 23. Specifically, the heat exchange passage portion 11*b* of the cooler 11 is disposed in the passage portion 23. Accordingly, the passage portion 23 is, specifically, provided with the heat exchange passage portion 11*b* of the cooler 11. The heat exchange passage portion 11*a* is a first heat exchange passage portion, and the heat exchange passage portion 11*b* is a second heat exchange passage portion.

The cooler 11 cools the working fluid that flows through the passage portion 22 by heat exchange. Specifically, the cooler 11 performs heat exchange between the working fluid that flows through the heat exchange passage portion 11*a* and the working fluid that flows through the heat exchange passage portion 11*b*. Accordingly, the cooler 11 performs heat exchange between the working fluid that flows through the passage portion 22 and the working fluid that flows through the passage portion 23.

The tank 10 constitutes a part of the passage portion 21 to which the passage portion 22 is connected. The tank 10 is positioned below the outlet portion 5*b*. Accordingly, the passage portion 22 is connected to a part of the passage portion 21 that is lower than the outlet portion 5*b*. The tank 10 also constitutes a lowermost portion of the passage portion 21. Accordingly, the passage portion 22 is connected to the lowermost portion of the passage portion 21. The tank 10 is positioned above the tank 7.

The piping 21*b* constitutes a part of the passage portion 21 on a downstream side from the tank 10 that is a part of the passage portion 21 to which the passage portion 22 is connected. The piping 22*a* is smaller in passage cross-sectional area than the piping 21*b*. Each of the passage cross-sectional areas of the piping 21*b*, the piping 22*a*, and the piping 22*b* may be constant. The passage cross-sectional area of the piping 22*b* may be equal to the passage cross-sectional area of the piping 22*a*. The passage portion 22, at any one or more parts, may have a passage cross-sectional area that is smaller than the passage cross-sectional area of a part of the piping 21*b* with the smallest passage cross-sectional area.

The following formula (1) and formula (2) illustrate a main temperature high-low relationship from a temperature T1 to a temperature T7 of the working fluid. The formula (3) illustrates a main pressure high-low relationship from a pressure P1 to a pressure P7 of the working fluid. Hereinafter, the liquefied working fluid and the liquid-state working fluid will be simply referred to as a liquid in some cases.

$$T6<T7<T1<<T2 \quad (1)$$

$$T2>>T3>>T4 \quad (2)$$

$$P6\cong P7\cong P1>P2>>P3>P4\cong P5 \quad (3)$$

The temperature T1 and the pressure P1 illustrate a state of the working fluid (that is, temperature and pressure) that flows into the gas-liquid separator 3 from the internal combustion engine 2. The temperature T2 and the pressure P2 illustrate a state of the steam that flows into the turbine 5. The temperature T3 and the pressure P3 illustrate a state of the steam in the tank 10. The temperature T4 and the pressure P4 illustrate a state of the liquid that flows into the tank 7 from the condenser 6. The temperature T5 and the pressure P5 illustrate a state of the liquid that flows into the tank 7 from the cooler 11. The temperature T6 and the pressure P6 illustrate a state of the liquid that flows into the cooler 11 from the pump 8. The temperature T7 and the pressure P7 illustrate a state of the liquid that flows into the gas-liquid separator 3 from the cooler 11.

Between the turbine 5 and the condenser 6, the steam is cooled in a low-temperature portion of the passage portion 21. The low-temperature portion is, for example, a passage wall surface of the piping 21*b*. As a result, the steam has a temperature T3' and a pressure P3' immediately before flowing into the condenser 6. The temperature T3' and the pressure. P3' are lower than the temperature T3 and the pressure P3 of the steam in the tank 10.

The steam is cooled in the passage portion 21 as described above. As a result, the cooled steam may be condensed. The liquefied working fluid may permeate into the turbine 5 from the passage portion 21 due to the arrangement of the outlet portion 5*b* and the inlet portion 6*a*. Specifically, for example, the liquefied working fluid may permeate into the turbine 5 from the passage portion 21 in a case where the piping is connected to the inlet portion 6*a* in a state of upward extension from the outlet portion 5*b*. When the liquefied working fluid permeates into the turbine 5 from the passage portion 21, rotation of a blade of the turbine 5 is impeded. Accordingly, the permeation of the liquid into the turbine 5 from the passage portion 21 causes reduction in output of the turbine 5.

In view of this, the waste heat recovery apparatus 1A is provided with the passage portion 22 that connects the passage portion 21 and the tank 7 to each other. In this case, the waste heat recovery apparatus 1A allows discharge of the liquid from the passage portion 21. Accordingly, the waste heat recovery apparatus 1A can prevent or suppress the reduction in the output of the turbine 5 that is attributable to the arrangement of the outlet portion 5*b* and the inlet portion 6*a*.

The liquid flows downward due to gravity. Accordingly, it can be said that the liquid that is to permeate into the turbine 5 from the passage portion 21 is captured at the part of the passage portion 21 that is lower than the outlet portion 5*b*. In view of this, the waste heat recovery apparatus 1A is, specifically, configured for the passage portion 21 to be connected to the inlet portion 6*a* through a position lower than the outlet portion 5*b* and for the passage portion 22 to be connected to the tank 10 as the part described above. In this case, the waste heat recovery apparatus 1A allows the capturing of the liquid that is to permeate into the turbine 5 from the passage portion 21.

More specifically, it is preferable that the waste heat recovery apparatus 1A be configured for the passage portion 21 to be connected to at least any one of the outlet portion 5*b* and the inlet portion 6*a* in a state where the passage portion 21 extends upward from the tank 10 as the part described above in this case. It is preferable that the waste heat recovery apparatus 1A be configured for the tank 10 as the part described above to be positioned above the tank 7.

In a case where the passage portion 21 is connected to the outlet portion 5*b* in a state where the passage portion 21 extends upward from the tank 10 as the part described above, the passage portion 22 can capture the liquid that flows into the passage portion 21 via the superheater 4 and the turbine 5 from the gas-liquid separator 3. The inflow of the liquid may occur in a case where a load of the internal combustion engine 2 changes rapidly. In a case where the passage portion 21 is connected to the inlet portion 6*a* in a state where the passage portion 21 extends upward from the tank 10 as the part described above, the passage portion 22 can capture the working fluid that is liquefied in the piping 21*b*.

In a case where the passage portion 21 is connected to each of the outlet portion 5*b* and the inlet portion 6*a* in a state where the passage portion 21 extends upward from the tank 10 as the part described above, the passage portion 22 can capture the liquid that flows into the passage portion 21 from the gas-liquid separator 3 and the working fluid that is liquefied in the piping 21*b*. Accordingly, it is preferable that the waste heat recovery apparatus 1A have the configuration described above. Also, the tank 10 constitutes the lowermost portion of the passage portion 21 in this case. In a case where the tank 10 as the part described above is positioned above the tank 7, the liquid can be guided by gravity from the tank 10 to the tank 7.

It can be said that the tank 10 as the lowermost portion of the passage portion 21 is a part where the working fluid is likely to accumulate. In view of this, the waste heat recovery apparatus 1A is, specifically, configured for the passage portion 22 to be connected to the tank 10 as the lowermost portion. In this case, the waste heat recovery apparatus 1A allows the discharge of the liquid from the passage portion 21 to be proper.

More specifically, it is preferable that the waste heat recovery apparatus 1A be configured for the tank 10 as the lowermost portion to be positioned below the outlet portion 5*b* in this case. Also, it is preferable that the waste heat recovery apparatus 1A be configured for the tank 10 as the lowermost portion to be positioned above the tank 7. Also, it is preferable that the waste heat recovery apparatus 1A be configured for the passage portion 21 to be connected to at least any one of the outlet portion 5*b* and the inlet portion 6*a* in a state where the passage portion 21 extends upward from the tank 10 as the lowermost portion.

Specifically, the waste heat recovery apparatus 1A is configured for the part of the passage portion 21 to which the passage portion 22 is connected to be the tank 10 that stores the liquid-state working fluid. In this case, the waste heat recovery apparatus 1A can discharge the liquid that is stored in the tank 10 to the tank 7. As a result, the liquid can be discharged from the passage portion 21 while the inflow of the steam to the passage portion 22 is prevented or suppressed. More specifically, it is preferable that the waste heat recovery apparatus 1A be configured for the tank 10 to have a similar configuration to the tank 10 as the lowermost portion described above in this case.

Specifically, the waste heat recovery apparatus 1A is configured to be provided with the cooler 11 that cools the working fluid which flows through the passage portion 22 by heat exchange. In this case, the waste heat recovery apparatus 1A can prevent or suppress rise in temperature and pressure in the tank 7. As a result, the reduction of the output of the turbine 5 can be prevented or suppressed. The reason for the reduction of the output of the turbine 5 due to the rise in temperature and pressure in the tank 7 will be described later.

Specifically, the waste heat recovery apparatus 1A is configured for the cooler 11 to perform heat exchange between the working fluid that flows through the passage portion 22 and the working fluid that flows through the passage portion 23. In this case, the waste heat recovery apparatus 1A can increase the temperature of the working fluid that is refluxed to the internal combustion engine 2. As a result, a steam generation amount increases in the internal combustion engine 2 to contribute to improvement of the output of the turbine 5.

Specifically, the waste heat recovery apparatus 1A is configured for the piping 22*a* to be smaller in passage cross-sectional area than the piping 21*b*. In other words, the waste heat recovery apparatus 1A is configured for the passage portion 22 to have a passage cross-sectional area smaller than the passage cross-sectional area of the part of the passage portion 21 on a downstream side from the tank 10 that is the part of the passage portion 21 to which the passage portion 22 is connected. In this case, the waste heat recovery apparatus 1A can suppress the inflow of the steam to the passage portion 22 in a situation in which the steam can flow through the passage portion 21 and the passage portion 22. Since the waste heat recovery apparatus 1A can suppress the inflow of the steam to the passage portion 22, the rise in temperature and pressure in the tank 7 can be prevented or suppressed. As a result, the reduction of the output of the turbine 5 can be prevented or suppressed.

Specifically, the waste heat recovery apparatus 1A is disposed in the vehicle 50 and has the internal combustion engine 2 as the heat exchanger that generates the steam. In this case, the probability of the inlet portion 6*a* being arranged above the outlet portion 5*b* increases due to constraints in mounting space in the vehicle 50. Accordingly, the waste heat recovery apparatus 1A is suitable for this case.

The condenser 6 is disposed for the working fluid to flow downward as described above. The output of the turbine 5 is reduced due to the rise in temperature and pressure in the tank 7. Hereinafter, the reasons thereof will be described in detail and, to this end, a relationship between a pressure ratio Pi/Po and the output of the turbine 5 will be described first. The pressure ratio Pi/Po is a pressure ratio between a high-pressure side turbine inlet pressure Pi and a low-pressure side turbine outlet pressure Po in which the turbine outlet pressure Po is the denominator.

Herein, the pressure ratio Pi/Po has to be increased if a greater output is to be generated in the turbine 5. However, the turbine outlet pressure Po is originally small. This is because the turbine outlet pressure Po is derived from an internal pressure of the condenser 6. Specifically, a low-pressure state is produced in the condenser 6 by the working fluid with a volume significantly decreased through condensation. The turbine outlet pressure Po is derived from the internal pressure of the condenser 6 that produces the low-pressure state in this manner, and thus is originally small.

Accordingly, the pressure ratio Pi/Po significantly decreases when the turbine outlet pressure Po rises even slightly. As a result, the output of the turbine 5 is significantly reduced. Specifically, the relationship between the pressure ratio Pi/Po and the output of the turbine 5 is, for example, as follows.

Figure 2:
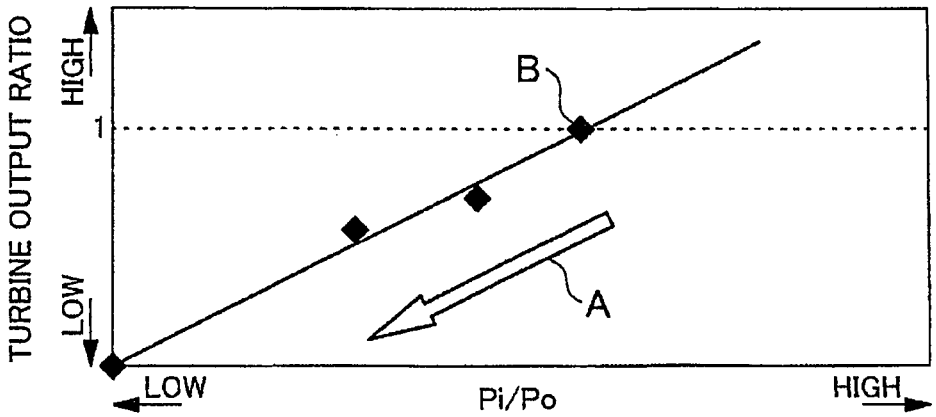
FIG. 2 is a diagram illustrating an example of a relationship between a pressure ratio and a turbine output ratio.

FIG. 2 is a diagram illustrating an example of the relationship between the pressure ratio Pi/Po and a turbine output ratio. FIG. 2 illustrates the example of the above-described relationship in a case where the internal combustion engine 2 is in a medium load operation. Arrow A illustrates a direction of change in which the turbine outlet pressure Po rises. Point B illustrates the pressure ratio Pi/Po and the turbine output ratio in a base condition. The turbine output ratio is a value that is obtained by dividing the output of the turbine 5 by the output of the turbine 5 in the base condition. Accordingly, the turbine output ratio that is illustrated by the point B is 1. As illustrated in FIG. 2, the turbine output ratio is reduced when the turbine outlet pressure Po rises. In other words, the output of the turbine 5 is reduced.

Figure 3:
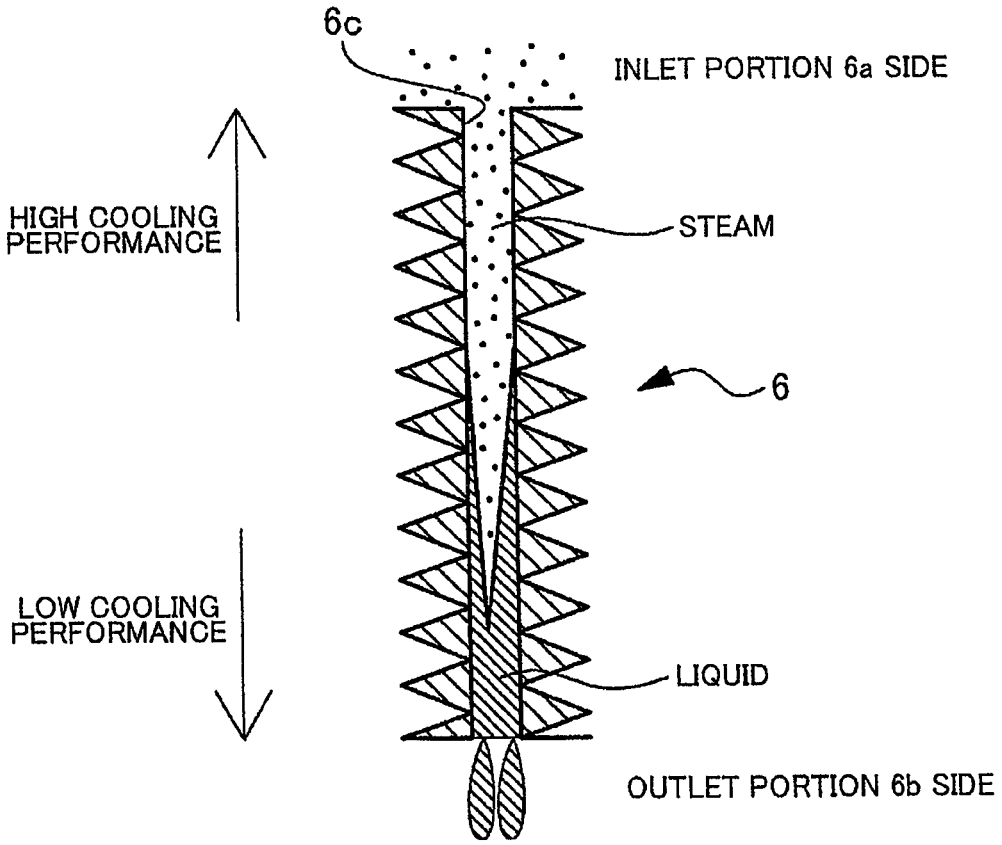
FIG. 3 is an explanatory diagram of a condenser.

Next, based on the above, the reason why the condenser 6 is disposed for the working fluid to flow downward will be described with reference to FIG. 3. FIG. 3 is an explanatory diagram of the condenser 6. For convenience of description, a state where the liquid remains in the condenser 6 is illustrated in FIG. 3. As illustrated in FIG. 3, a cooling passage portion 6*c* is disposed in the condenser 6. The cooling passage portion 6*c* is cooled by fins disposed around the cooling passage portion 6*c*. On the inlet portion 6*a* side, a passage wall surface of the cooling passage portion 6*c* directly cools the steam. As a result, the steam is actively condensed on the inlet portion 6*a* side. The liquid that is produced through the condensation moves toward the outlet portion 6*b* along the passage wall surface of the cooling passage portion 6*c*.

However, when the discharge of the liquid out of the condenser 6 is delayed, the liquid gradually remains in the cooling passage portion 6*c* from the outlet portion 6*b* side toward the inlet portion 6*a* side. At the part where the liquid remains, heat transfer resistance between the passage wall surface of the cooling passage portion 6*c* and the steam increases. Accordingly, a cooling performance of the condenser 6 is gradually reduced from the outlet portion 6*b* side toward the inlet portion 6*a* side when the discharge of the liquid out of the condenser 6 is delayed.

In view of this, the condenser 6 is disposed in the waste heat recovery apparatus 1A for the working fluid to flow downward, and thus the discharge of the liquid out of the condenser 6 is promoted by gravity and the reduction of the cooling performance of the condenser 6 is prevented or suppressed. When the reduction of the cooling performance of the condenser 6 is prevented or suppressed, rise in the internal pressure of the condenser 6 is prevented or suppressed. Accordingly, the rise of the turbine outlet pressure Po is prevented or suppressed. As a result, the reduction of the output of the turbine 5 is prevented or suppressed.

In a case where the condenser 6 is disposed in this manner, the probability of the inlet portion 6*a* being arranged above the outlet portion 5*b* further increases along with the constraints in the mounting space in the vehicle 50. Accordingly, the waste heat recovery apparatus 1A is particularly suitable for a case where the waste heat recovery apparatus 1A is disposed in the vehicle 50 and has the internal combustion engine 2 as the heat exchanger that generates the steam with the condenser 6 disposed for the working fluid to flow downward.

The reason for the reduction of the output of the turbine 5 due to the rise in temperature and pressure in the tank 7 is as follows. The condenser 6 communicates internally with the tank 7. Accordingly, the rise in temperature and pressure in the tank 7 causes the internal pressure of the condenser 6 to rise. The rise in the internal pressure of the condenser 6 causes the turbine outlet pressure Po to rise. As a result, the output of the turbine 5 is reduced. Alternatively, the discharge of the liquid from the condenser 6 is inhibited when the temperature and the pressure in the tank 7 rise. As a result, the cooling performance of the condenser 6 is reduced and the internal pressure of the condenser 6 rises. Accordingly, the output of the turbine 5 is reduced. Specifically, the temperature and the pressure in the tank 7 rise as follows in a case where a high-temperature liquid flows into the tank 7.

Figure 4:
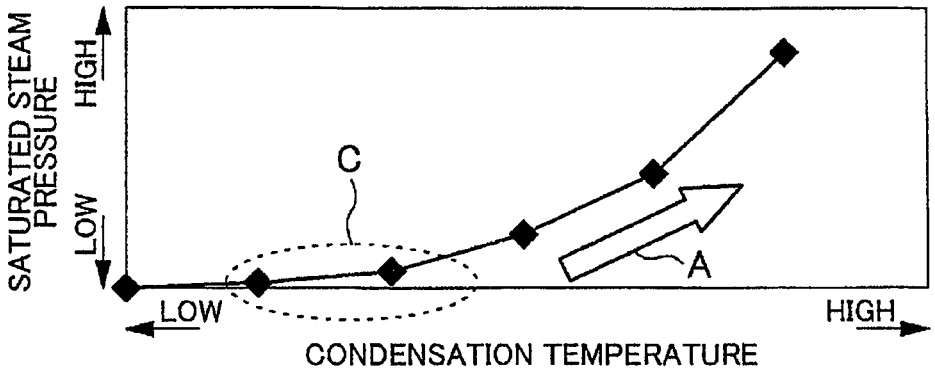
FIG. 4 is a diagram illustrating a relationship between a saturated steam pressure and a condensation temperature.

FIG. 4 is a diagram illustrating a relationship between a saturated steam pressure and a condensation temperature. Region C illustrates a normal operation region of the condenser 6. Arrow A is as described above. When the high-temperature liquid flows into the tank 7 from the tank 10, the temperature of the liquid that is stored in the tank 7 increases. As a result, the saturated steam pressure in the tank 7 increases. The saturated steam pressure in the tank 7 that increases in this manner causes the turbine outlet pressure Po to rise, for example, as described above.

The rise in temperature and pressure in the tank 7 is attributable to the liquid and the steam discharged from the passage portion 21. The discharge of the steam from the passage portion 21 is attributable to the discharge of the liquid from the passage portion 21. The discharge of the liquid from the passage portion 21 is attributable to the arrangement of the outlet portion 5*b* and the inlet portion 6*a*. Accordingly, the reduction of the output of the turbine 5 due to the rise in temperature and pressure in the tank 7 is attributable to the arrangement of the outlet portion 5*b* and the inlet portion 6*a*.

Figure 5:
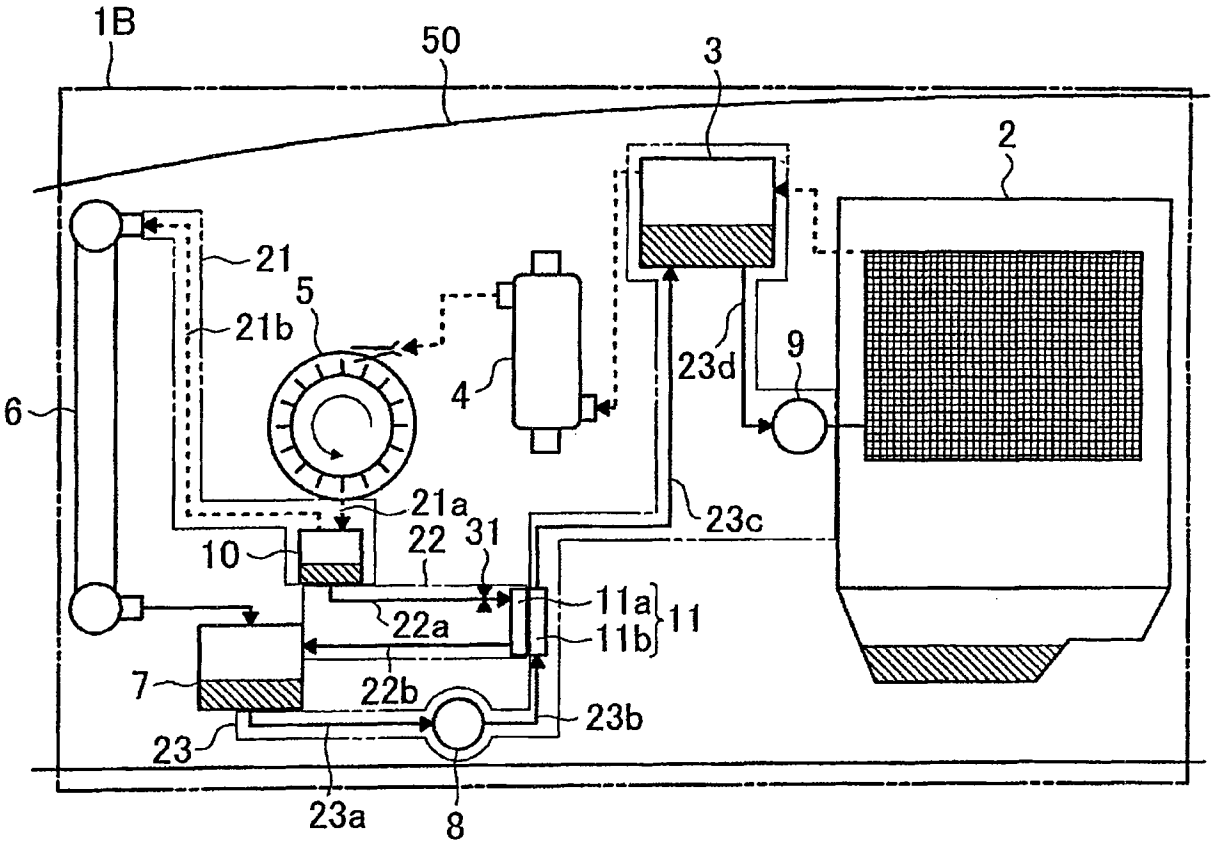
FIG. 5 is a schematic configuration diagram of a waste heat recovery apparatus according to a second embodiment.

FIG. 5 is a schematic configuration diagram of a waste heat recovery apparatus 1B. The waste heat recovery apparatus 1B is substantially the same as the waste heat recovery apparatus 1A except that the waste heat recovery apparatus 1B is further provided with a throttle valve 31. The throttle valve 31 is disposed in the passage portion 22. Specifically, the throttle valve 31 is disposed to be interposed in the piping 22*a*. The throttle valve 31 is an example of a limiting valve that limits the flow of the steam of the working fluid in the passage portion 22. In the waste heat recovery apparatus 1B, the throttle valve 31 suppress the inflow of the steam to the passage portion 22 in a situation in which the steam can flow through the passage portion 21 and the passage portion 22. Accordingly, the waste heat recovery apparatus 1B can prevent or suppress the rise in temperature and pressure in the tank 7. As a result, the reduction of the output of the turbine 5 can be prevented or suppressed.

The passage portion 22 may be understood as being configured to be further provided with the throttle valve 31 in the waste heat recovery apparatus 1B. The piping 22*a* may not be smaller in passage cross-sectional area than the piping 21*b*.

Figure 6:
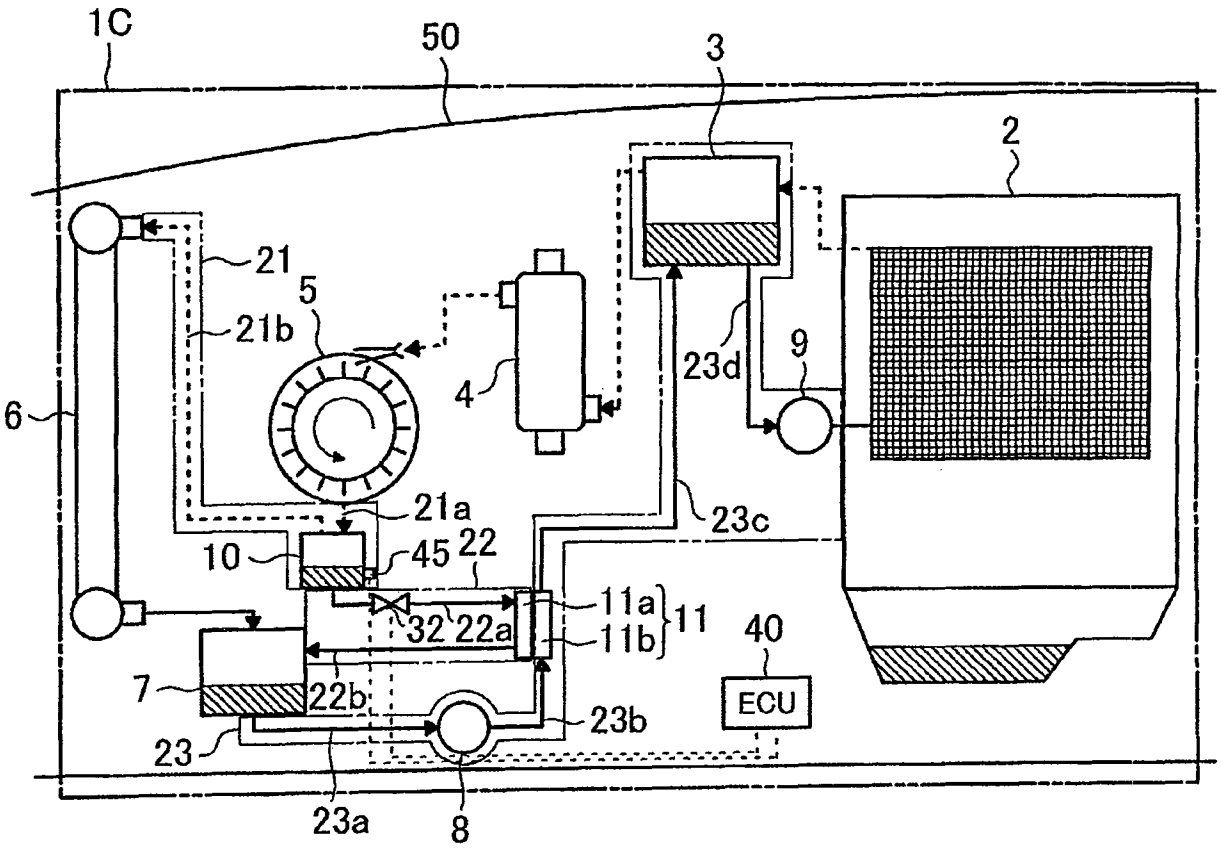
FIG. 6 is a schematic configuration diagram of a waste heat recovery apparatus according to a third embodiment.

FIG. 6 is a schematic configuration diagram of a waste heat recovery apparatus 1C. The waste heat recovery apparatus 1C is substantially the same as the waste heat recovery apparatus 1A except that the waste heat recovery apparatus 1C is further provided with an electromagnetic valve 32 and an ECU 40. The electromagnetic valve 32 is disposed in the passage portion 22. Specifically, the electromagnetic valve 32 is disposed to be interposed in the piping 22*a*. The electromagnetic valve 32 is an example of the limiting valve.

The ECU 40 is an electronic control device. The electromagnetic valve 32 is electrically connected, as a control object, to the ECU 40. A sensor 45 is electrically connected to the ECU 40. The sensor 45 detects a liquid storage amount in the passage portion 21. Specifically, the liquid storage amount is a liquid storage amount at the part of the passage portion 21 to which the passage portion 22 is connected. Accordingly, the sensor 45, specifically, detects the liquid storage amount in the tank 10. The sensor 45 is a level sensor that detects the level of the liquid storage amount. The sensor 45 may, for example, be a pressure sensor that detects pressure which changes according to the liquid storage amount.

The ECU 40 controls the electromagnetic valve 32 based on an output from the sensor 45. As a result, the electromagnetic valve 32 is operated according to the liquid storage amount in the passage portion 21. Specifically, the electromagnetic valve 32 is closed in a case where the liquid storage amount in the passage portion 21 is smaller than a predetermined value and is opened in a case where the liquid storage amount in the passage portion 21 is larger than a predetermined value. A case where the liquid storage amount is the predetermined value can be included in both of the cases. In this case, the waste heat recovery apparatus 1C can prevent the flow of the steam from the tank 10 to the tank 7. The electromagnetic valve 32 may be closed in a case where the liquid storage amount in the passage portion 21 is zero and may be opened in a case where the liquid storage amount in the passage portion 21 is not zero. Even in this case, the waste heat recovery apparatus 1C can prevent or suppress the flow of the steam from the tank 10 to the tank 7.

The passage portion 22 may be understood as being configured to be further provided with the electromagnetic valve 32 in the waste heat recovery apparatus 1C. The piping 22*a* may not be smaller in passage cross-sectional area than the piping 21*b*. The waste heat recovery apparatus 1C may be provided with, for example, a flow rate control valve instead of the electromagnetic valve 32.

Figure 7:
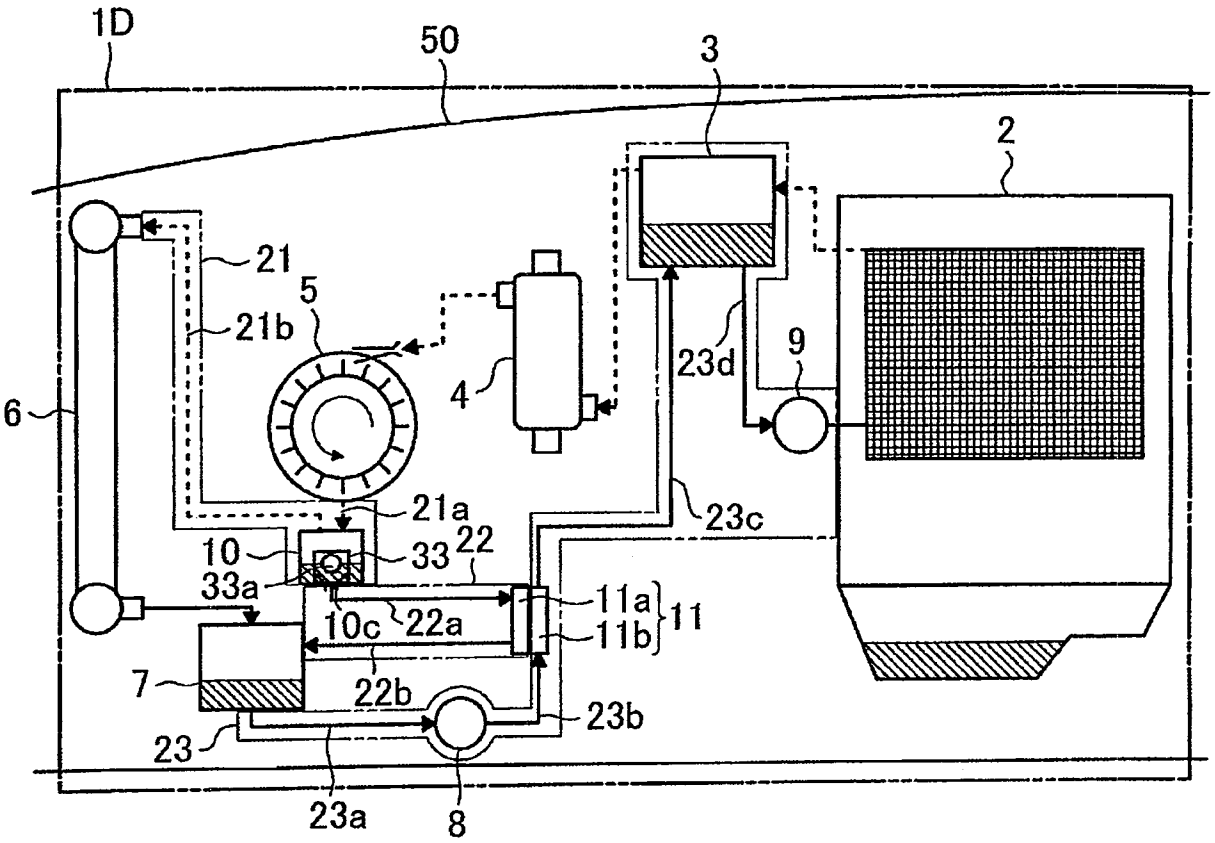
FIG. 7 is a schematic configuration diagram of a waste heat recovery apparatus according to a fourth embodiment.

FIG. 7 is a schematic configuration diagram of a waste heat recovery apparatus 1D. The waste heat recovery apparatus 1D is substantially the same as the waste heat recovery apparatus 1A except that the waste heat recovery apparatus 1D is further provided with a float valve 33. The float valve 33 is disposed in the passage portion 21. Specifically, the float valve 33 is disposed in the tank 10. The float valve 33 is disposed in the outlet portion 10*c*. The float valve 33 is operated by a float 33*a* that is smaller in specific gravity than the liquid. The float valve 33 is operated according to the liquid storage amount in the passage portion 21. Specifically, the float valve 33 is operated according to the liquid storage amount in the tank 10. The float valve 33 is an example of the limiting valve and limits the flow of the steam in the passage portion 22 by opening or closing the outlet portion 10*c*. The waste heat recovery apparatus 1D can prevent or suppress the flow of the steam from the tank 10 to the tank 7 by closing the outlet portion 10*c* by using the float valve 33.

The passage portion 21 may be understood as being configured to be further provided with the float valve 33 in the waste heat recovery apparatus 1D. The piping 22*a* may not be smaller in passage cross-sectional area than the piping 21*b*.

Figure 8:
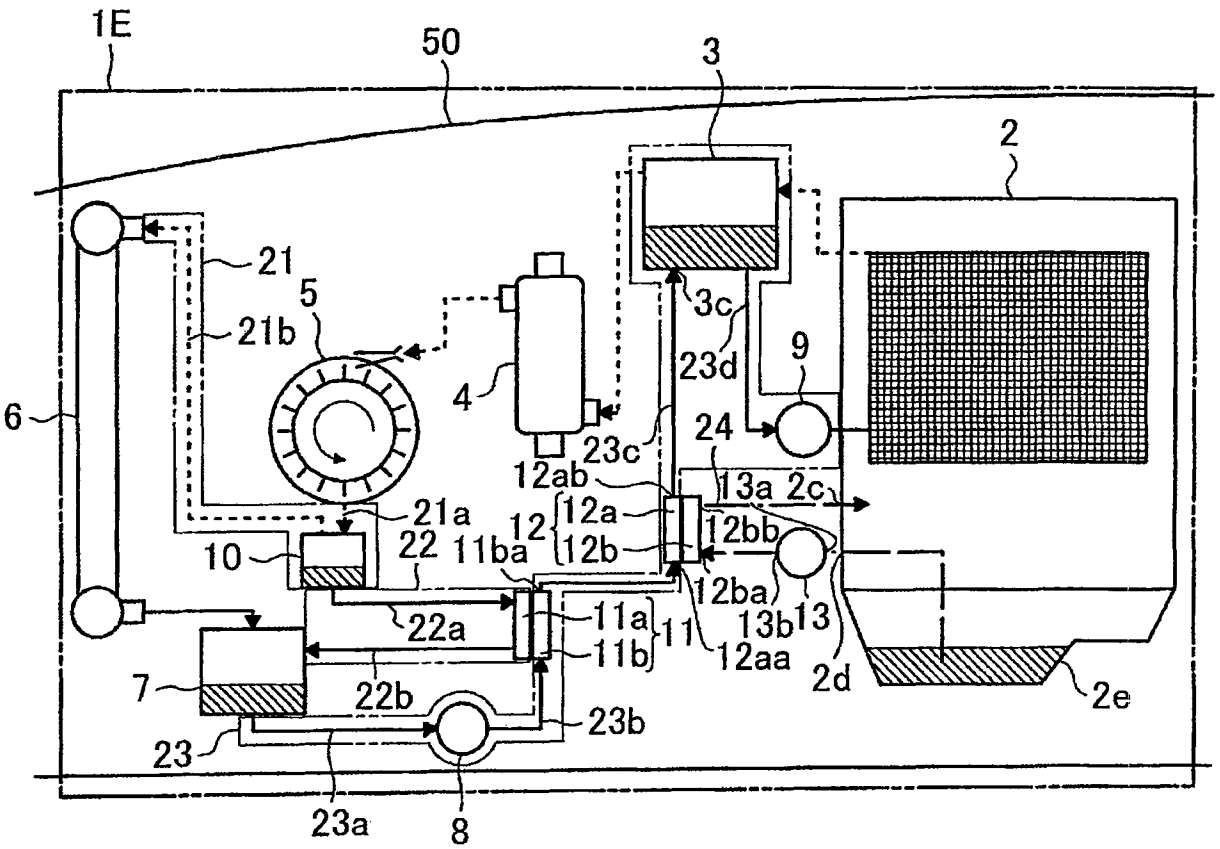
FIG. 8 is a schematic configuration diagram of a waste heat recovery apparatus according to a fifth embodiment.

FIG. 8 is a schematic configuration diagram of a waste heat recovery apparatus 1E. The waste heat recovery apparatus 1E is substantially the same as the waste heat recovery apparatus 1A except that the waste heat recovery apparatus 1E is further provided with a heater 12, a pump 13, and a passage portion 24. Similar change may be performed on the waste heat recovery apparatuses 1B, 1C, 1D.

The pump 13 is an oil pump. An inlet portion 13*a* of the pump 13 is directly connected to an outlet portion 2*d* of the internal combustion engine 2. The outlet portion 2*d* is an engine oil outlet portion. The pump 13 suctions engine oil from an oil pan 2*e* via the outlet portion 2*d*. The suctioned engine oil is pumped to the passage portion 24 by the pump 13. The inlet portion 13*a* may be indirectly connected to the outlet portion 2*d*. The passage portion 24 is an oil passage portion and allows the engine oil to flow. Specifically, the passage portion 24 is piping. The passage portion 24 connects an outlet portion 13*b* of the pump 13 and an inlet portion 2*c* of the internal combustion engine 2 to each other. The inlet portion 2*c* is an engine oil inlet portion. The engine oil is supplied to each portion of the internal combustion engine 2 from the inlet portion 2*c*.

The heater 12 is disposed in the passage portion 23. Specifically, a heat exchange passage portion 12*a* of the heater 12 is disposed in the passage portion 23. The heat exchange passage portion 12*a* is a first heat exchange passage portion of the heater 12 and is disposed to be interposed in the piping 23*c*. A part of the piping 23*c* on an upstream side from the heater 12 connects the inlet portion 11*ba* and an inlet portion 12*aa* of the heat exchange passage portion 12*a* to each other. A part of the piping 23*c* on a downstream side from the heater 12 connects an outlet portion 12*ab* of the heat exchange passage portion 12*a* and the inlet portion 3*c* to each other.

The heater 12 is also disposed in the passage portion 24. Specifically, a heat exchange passage portion 12*b* of the heater 12 is disposed in the passage portion 24. The heat exchange passage portion 12*b* is a second heat exchange passage portion of the heater 12 and is disposed to be interposed in the passage portion 24. A part of the passage portion 24 on an upstream side from the heater 12 connects the outlet portion 13*b* and an inlet portion 12*ba* of the heat exchange passage portion 12*b* to each other. A part of the passage portion 24 on a downstream side from the heater 12 connects an outlet portion 12*bb* of the heat exchange passage portion 12*b* and the inlet portion 2*c* to each other.

The heater 12 heats the working fluid that flows through the passage portion 23 after passing through the cooler 11 by heat exchange. Specifically, the heater 12 performs heat exchange between the working fluid that flows through the heat exchange passage portion 12*a* and the engine oil that flows through the heat exchange passage portion 12*b*. Accordingly, the heater 12 performs heat exchange between the working fluid that flows through the passage portion 23 and the engine oil that flows through the passage portion 24.

The waste heat recovery apparatus 1E is configured for the heater 12 to heat the working fluid that flows through the passage portion 23 after passing through the cooler 11 by heat exchange. In this case, the waste heat recovery apparatus 1E can increase the temperature of the working fluid that is refluxed to the internal combustion engine 2. As a result, the steam generation amount increases in the internal combustion engine 2 to contribute to the improvement of the output of the turbine 5.

Specifically, the waste heat recovery apparatus 1E is configured for the heater 12 to heat the working fluid by performing heat exchange between the working fluid that flows through the passage portion 23 and the engine oil that flows through the passage portion 24. In this case, the waste heat recovery apparatus 1E can cool the engine oil and increase the temperature of the working fluid at the same time. As a result, reliability of the internal combustion engine 2 can be increased. The waste heat recovery apparatus 1E that has the above-described configuration is suitable in that the waste heat recovery apparatus 1E can cool the engine oil, which is likely to have a high temperature, while performing ebullient cooling so as to generate the steam in the internal combustion engine 2.

The passage portion 23 may be understood as being configured to be further provided with the heater 12 in the waste heat recovery apparatus 1E. The passage portion 24 may be understood as being configured to be further provided with the heater 12, the pump 13, and oil piping in addition to the piping that allows the engine oil to flow.

The embodiments described above are merely examples of the invention. The invention is not limited thereto, and various modifications and changes are possible without departing from the scope of the spirit of the invention described in the claims.

For example, a plurality of the parts of the first passage portion to which the second passage portion is connected may be present. In this case, the second passage portion can branch into a plurality of parts for connection. The part of the first passage portion to which the second passage portion is connected may be obliquely extending piping. In this case, the liquid can be captured in a descending stage. The part of the first passage portion to which the second passage portion is connected may be, for example, piping as described above.

Figure 9:
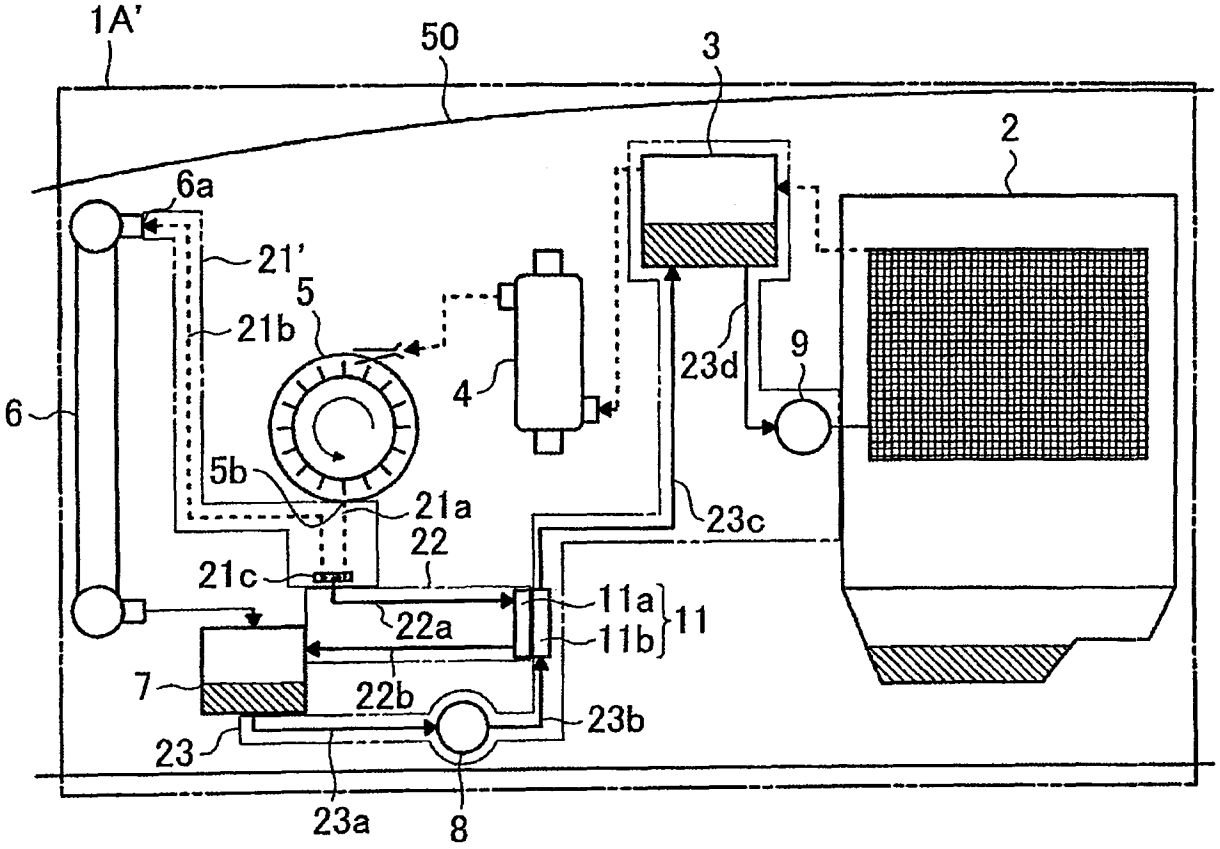
FIG. 9 is a diagram illustrating a modification example of the first embodiment.

FIG. 9 is a diagram illustrating a waste heat recovery apparatus 1A' that is a modification example of the waste heat recovery apparatus 1A. The waste heat recovery apparatus 1A' is substantially the same as the waste heat recovery apparatus 1A except that the waste heat recovery apparatus 1A' is provided with a passage portion 21' instead of the passage portion 21. The passage portion 21' is substantially the same as the passage portion 21 except that the passage portion 21' is provided with piping 21*c* instead of the tank 10. The piping 21*c* constitutes a part of the passage portion 21' to which the passage portion 22 is connected. The piping 21*c* also constitutes a part of the passage portion 21' that is lower than the outlet portion 5*b* and a lowermost portion of the passage portion 21'. The waste heat recovery apparatus 1A' also can prevent or suppress the reduction of the output of the turbine 5 that is attributable to the arrangement of the outlet portion 5*b* and the inlet portion 6*a*.

The invention claimed is:

1. A waste heat recovery apparatus comprising:

a heat exchanger configured to evaporate a working fluid with heat from a heat source and generate steam;

an expander configured to recover heat energy of the generated steam as power;

a condenser configured to condense the steam passing through the expander, an inlet portion of the condenser being arranged above an outlet portion of the expander;

a first tank configured to store the working fluid liquefied by the condenser;

a reflux portion configured to reflux the liquefied working fluid in the first tank to the heat exchanger;

a first passage portion that connects the outlet portion of the expander and the inlet portion of the condenser to each other; and a second passage portion that connects the first passage portion and the first tank to each other, wherein the second passage portion receives a liquid portion of the working fluid from the first passage portion while the first passage portion provides a gas portion of the working fluid to the condenser.

2. The waste heat recovery apparatus according to claim 1, wherein the first passage portion is connected to the inlet portion of the condenser through a position lower than the outlet portion of the expander, and the second passage portion is connected to a part of the first passage portion lower than the outlet portion of the expander.

3. The waste heat recovery apparatus according to claim 1, wherein the second passage portion is connected to a lowermost portion of the first passage portion.

4. The waste heat recovery apparatus according to claim 1, wherein a part of the first passage portion to which the second passage portion is connected is a second tank configured to store the liquefied working fluid.

5. The waste heat recovery apparatus according to claim 1, further comprising:

a cooler disposed in the second passage portion, the cooler configured to cool the working fluid flowing through the second passage portion by heat exchange.

6. The waste heat recovery apparatus according to claim 5, wherein the cooler performs heat exchange between the working fluid flowing through the second passage portion and the working fluid flowing through the reflux portion.

7. The waste heat recovery apparatus according to claim 6, further comprising:

a heater configured to heat the working fluid flowing through the reflux portion after passing through the cooler by heat exchange.

8. The waste heat recovery apparatus according to claim 1, wherein the second passage portion is smaller in passage cross-sectional area than a part of the first passage portion on a downstream side from a part of the first passage portion to which the second passage portion is connected.

9. The waste heat recovery apparatus according to claim 1, further comprising:

a limiting valve configured to limit a flow of the steam of the working fluid in the second passage portion.

10. The waste heat recovery apparatus according to claim 9, wherein the limiting valve is operated according to the liquefied working fluid storage amount in the first passage portion.

11. The waste heat recovery apparatus according to claim 10, wherein the limiting valve is a float valve operated by a float smaller in specific gravity than the liquefied working fluid, the float valve being disposed in the first passage portion.

12. The waste heat recovery apparatus according to claim 1, wherein the heat exchanger is an internal combustion engine and the waste heat recovery apparatus is disposed in a vehicle.

13. The waste heat recovery apparatus according to claim 1, wherein the second passage portion receives the liquid portion of the working fluid from the first passage portion by separating the liquid portion from the gas portion of the working fluid that is supplied to the condenser by the first passage portion.

* * * * *